US008976032B2

(12) United States Patent
Mukherjee et al.

(10) Patent No.: US 8,976,032 B2
(45) Date of Patent: Mar. 10, 2015

(54) SYSTEMS, METHODS AND COMPUTER-READABLE MEDIA FOR IDENTIFYING AN ANONYMOUS PATIENT

(75) Inventors: Chinmoy Mukherjee, Bangalore (IN); Nataraj Subbaraya Kuntagod, Bangalore (IN)

(73) Assignee: Infosys Limited, Bangalore (CA)

( * ) Notice: Subject to any disclaimer, the term of this patent is extended or adjusted under 35 U.S.C. 154(b) by 448 days.

(21) Appl. No.: 13/530,903

(22) Filed: Jun. 22, 2012

(65) Prior Publication Data

US 2013/0234854 A1 Sep. 12, 2013

(30) Foreign Application Priority Data

Mar. 7, 2012 (IN) ..... 856/CHE/2012

(51) Int. Cl.
*G08B 23/00* (2006.01)

(52) U.S. Cl.
USPC ..... 340/573.1; 340/573.7; 340/539.12; 600/300; 600/301

(58) Field of Classification Search
CPC ..... A61B 5/02; A61B 5/0002; A61B 5/0022; A61B 5/0024; G06F 19/32; G06F 19/322
USPC ..... 340/573.1, 573.7, 870.16, 517, 539.11, 340/539.12; 600/300, 301, 549; 128/920, 128/903; 702/19
See application file for complete search history.

(56) References Cited

U.S. PATENT DOCUMENTS 3,972,320 A 8/1976 Kalman
4,827,943 A 5/1989 Boran et al.
6,416,471 B1 7/2002 Kumar et al.
7,321,862 B2 1/2008 Rosenfeld et al.
7,336,187 B2 2/2008 Hubbard, Jr. et al.
2002/0013538 A1 1/2002 Teller
2006/0293571 A1 12/2006 Bao et al.
2007/0156450 A1 7/2007 Roehm et al.
2010/0198094 A1 8/2010 Turicchia et al.
2010/0298656 A1 11/2010 McCombie et al.
2011/0148622 A1 6/2011 Judy et al.

FOREIGN PATENT DOCUMENTS

GB 2216266 A 4/1989

OTHER PUBLICATIONS

Jovanov et al., "A Wireless Body Area Network of Intelligent Motion Sensors for Computer Assisted Physical Rehabilitation," Journal of NeuroEngineering and Rehabilitation, 10 pp. (2005).

(Continued)

*Primary Examiner* — Steven Lim
*Assistant Examiner* — Hongmin Fan
(74) *Attorney, Agent, or Firm* — LeClairRyan, a Professional Corporation

(57) ABSTRACT

The present invention provides a system, a method and a computer program product for, identifying an anonymous patient in a health care location, when the anonymous patient requires medical attention. A health parameter data of the patient is acquired by a sensor unit, and transmitted to a gateway module associated with the patient. In an event the acquired health parameter data transgresses preconfigured limits or preconfigured pattern(s); an alert is generated by the gateway module, and transmitted to a context server. The context server is configured to validate the alert; instruct the gateway module to emit a colored light corresponding to the color code and transmit the gateway identifier, the color code and a location of a nearest connector, to a medical agent for the purpose of locating the patient.

29 Claims, 4 Drawing Sheets

(56) References Cited

OTHER PUBLICATIONS

Gao et al., "Improving Patient Monitoring and Tracking in Emergency Response," 6 pp. (Jul. 2005).

Gao et al., "Wireless Medical Sensor Networks in Emergency Response: Implementation and Pilot Results," 6 pp. (May 2008).

Shahriyar et al., "Intelligent Mobile Heath Monitoring System (IMHMS)," International Journal of Control and Automation 2(3):13-28 (2009).

SYSTEMS, METHODS AND COMPUTER-READABLE MEDIA FOR IDENTIFYING AN ANONYMOUS PATIENT

CROSS-REFERENCE TO RELATED APPLICATIONS

This application claims the benefit of Indian Patent Application Filing No. 856/CHE/2012, filed Mar. 7, 2012, which is hereby incorporated by reference in its entirety.

FIELD

The present invention relates generally to a method and system for remotely identifying and monitoring patients in a health care location. More specifically, the present invention relates to a method and system for identifying an anonymous patient.

BACKGROUND

In a typical health care location, patients require continuous monitoring in order to attend to a medical emergency occurring with a patient. Remote patient monitoring systems enable efficient usage of time and resources of a medical agent such as a nurse, doctor and other medical personnel to attend to the patient experiencing the medical emergency. Existing remote patient monitoring systems include diagnostic monitoring devices such as medical sensors for measuring at least one physiological parameter such as ECG, blood pressure, heart rate, oxygen saturation level, glucose level and the like. A medical event such as a medical emergency is detected by the remote patient monitoring systems, when a measured physiological parameter exceeds predetermined limits, the measured physiological parameter being of a discrete nature. Alternatively, the medical event is detected for a measured physiological parameter of continuous nature when the measured physiological parameter fails to match a preconfigured pattern. However, for the purpose of detecting the medical event, it is essential that the medical sensors be associated with at least one demographic detail of the patient. Instances of demographic details include name, age, gender, bed location and the like so that when the medical event is detected the medical agent may easily locate and identify the patient.

Attaching of the medical sensors and associating each of the medical sensors with the demographic details of the patient tends to consume critical time and requires the patient to be in his full state of consciousness, in order to provide necessary personal data. In another instance, where the health care location has to attend to numerous patients that are inflicted by a major disaster it may be impossible to provide individual bed locations to each patient. As a result, it may not be possible to attach the demographic details of the patient with the medical sensors in a situation where the patient needs immediate medical attention, is unable to provide the necessary personal data, or when the patient does not have a fixed location. Further, it could be inconvenient to associate the demographic details of the patient owing to the patient's health condition, privacy and security.

Secondly, even though existing building location technologies provide accurate identification of a person whose demographic details are unknown, the cost of installing such location technologies in the medical sensors are aforementioned are high. In lieu of the high expenditure involved in employing the existing building technologies with the medical sensors and peripheral monitoring hardware, an inexpensive method for identifying the patient attached with the medical sensors is desired.

Hence there is a need for a method and system that can remotely monitor the patient without associating the demographic detail of the patient with the medical sensors. Additionally, a method and system that can ensure effecting monitoring of the patient the moment the medical sensor is attached to the patient is desired.

SUMMARY

The present invention provides a system and a method for identifying a patient, for the purpose of remote monitoring. In accordance with a disclosed embodiment, the system may include one or more sensor units associated with the patient for acquiring a health parameter data of the patient and transmitting the acquired health parameter data over a first communication link. The system may further include a gateway module in communication with the one or more sensor units; the gateway module comprising; a receiver module, for receiving the acquired health parameter data from the first communication link; an edge intelligence module for aggregating a set of received acquired health parameter data and generating an alert when the aggregated set of health parameter data transgresses one of a set of preconfigured limits or preconfigured pattern(s) in a first time frame; and a transmitter module for transmitting the aggregated set of health parameter data periodically and the generated alert over a second communication link to a context server, where the generated alert includes a sensor identifier, a gateway identifier, a connector identifier of a connector nearest to the gateway module, when the alert was generated, and the aggregated set of health parameter data of the first time frame. The context server for; receiving the aggregated set of health parameter data periodically in the time interval and the generated alert; generating a unique patient identifier for the patient when the sensor identifier, the gateway identifier are received from the gateway module for a first time; validating the received alert; retrieving a location of the connector from a lookup table; assigning a color code for the validated alert; transmitting the color code, the gateway identifier, and the location of the connector to a medical agent, in an event the received alert is valid and instructing the gateway module to emit a colored light associated with the color code.

In an additional embodiment, a method for identifying a patient for the purpose of remote monitoring is disclosed. The method includes, acquiring, by a sensor unit, a health parameter data of the patient; transmitting the acquired health parameter data to a gateway module over a first communication link; aggregating, by an edge intelligence module disposed within a gateway module, a set of transmitted health parameter data periodically within a time interval; generating an alert, when the aggregated set of health parameter data transgresses one of a set of preconfigured limits or preconfigured pattern(s)in a first time frame; retransmitting, by a transmitter module disposed within the gateway module, one of the aggregated set of health parameter data and the generated alert over a second communication link, where the generated alert includes a sensor identifier, a gateway identifier, a connector identifier of a connector, and the transgressed set of health parameter data; receiving, by a context server, the aggregated set of health parameter data periodically within the time interval and the generated alert from the second communication link; validating the received alert, transmitting a color code, the gateway identifier and a location of the connector to a medical agent, when the alert is validated, and instructing the gateway module to emit a colored light associated with the color code on validation of the alert. The preconfigured limits are usually preset for the set of health parameter data that are discrete in nature and the preconfigured patterns are preferably utilized as a reference for the set of health parameter data that are continuous in nature and can be described only in terms of physiological waveforms.

In another embodiment, a computer program product for identifying a patient for the purpose of remote monitoring is disclosed. The computer program product when executed by a computing device performs the method of identifying the patient. The method includes, acquiring, by a sensor unit, a health parameter data of the patient; transmitting the acquired health parameter data to a gateway module over a first communication link; aggregating, by an edge intelligence module disposed within a gateway module, a set of transmitted health parameter data periodically within a time interval; generating an alert, when the aggregated set of health parameter data transgresses one of a set of preconfigured limits and patterns in a first time frame; retransmitting, by a transmitter module disposed within the gateway module, one of the aggregated set of health parameter data and the generated alert over a second communication link, where the generated alert includes a sensor identifier, a gateway identifier, a connector identifier of a connector, and the transgressed set of health parameter data; receiving, by a context server, the aggregated set of health parameter data periodically within the time interval and the generated alert from the second communication link; validating the received alert, transmitting a color code, the gateway identifier and a location of the connector to a medical agent, when the alert is validated, and instructing the gateway module to emit a colored light associated with the color code on validation of the alert.

These and other features, aspects, and advantages of the present invention will be better understood with reference to the following description and claims.

While systems and methods are described herein by way of example and embodiments, those skilled in the art recognize that systems and methods for electronic financial transfers are not limited to the embodiments or drawings described. It should be understood that the drawings and description are not intended to be limiting to the particular form disclosed. Rather, the intention is to cover all modifications, equivalents and alternatives falling within the spirit and scope of the appended claims. Any headings used herein are for organizational purposes only and are not meant to limit the scope of the description or the claims. As used herein, the word "may" is used in a permissive sense (i.e., meaning having the potential to) rather than the mandatory sense (i.e., meaning must). Similarly, the words "include", "including", and "includes" mean including, but not limited to.

DETAILED DESCRIPTION

Disclosed embodiments provide computer-implemented methods, systems, and computer-program products for identifying a patient, requiring medical attention in a health care center such as a hospital, when the demographic details of the patient are unknown. The methods and systems disclosed herein, enable accurate identification of the patient, the patient being attached to one or more medical sensors that monitor at least one physiological parameter of the patient such as ECG, blood pressure, heart rate, oxygen saturation level, glucose level and the like. When the monitored physiological parameter exceeds predetermined limits or preconfigured patterns, a medical event to notify a medical emergency is generated. The system disclosed herein, provides for determining a location of the patient and notifying a medical agent of the location, in order to attend to the patient.

Figure 1:
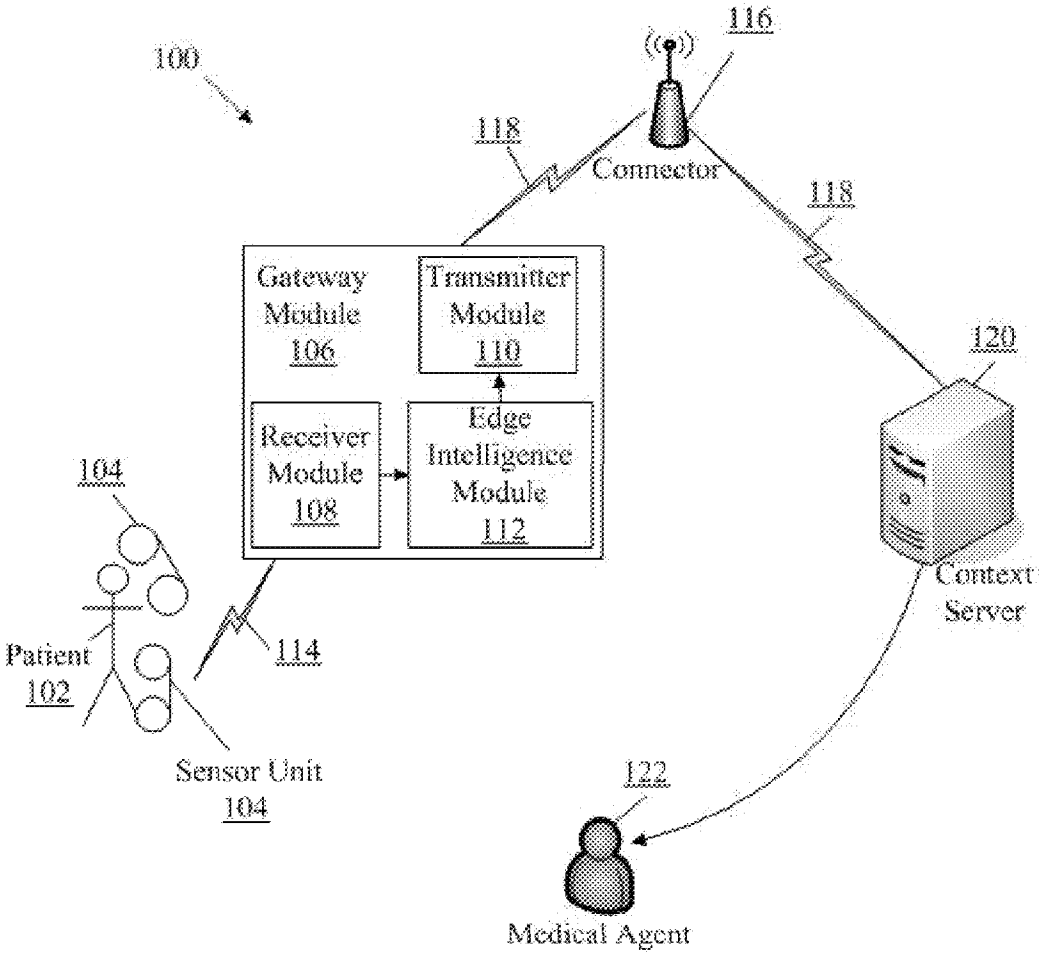
FIG. 1 shows an exemplary system for identifying a patient.

FIG. 1 illustrates an exemplary system 100 in which various embodiments of the invention can be practiced. In an embodiment of the present invention, the exemplary system 100 includes one or more sensor units 104 attached to a patient 102, a gateway module 106 in communication with the one or more sensor units 104 via a first communication link 114, a connector 116 that is in communication with the gateway module 118 via a second communication link 118, and a context server 120 which can be communication with the gateway module 106 over the second communication link 118 via the connector 116.

The one or more sensor units 104 can include body worn monitoring devices that monitor and measure at least one health parameter data of the patient such as a physiological condition of the patient. Instances of the physiological condition include body temperature, metabolic rate, ECG, blood pressure, heart rate, oxygen saturation level, glucose level and the like. It may be noted that the one or more sensor units 104 can be connected, affixed, or coupled directly or indirectly to the patient 102. A sensor unit 104, is preferably a low powered device that can communicate via wireless technologies such as Bluetooth, Near Field Communication (NFC), and such low powered communication links Instances of the sensor unit 103 can include, but is not limited to, a heart rate sensor, a pulse rate sensor, and a Electrocardiogram sensor. In the disclosed embodiment, each sensor unit 104 can be associated with a sensor identifier, which can be an identification code of the sensor unit 104. Each sensor unit 104 is configured to acquire a health parameter data of the patient 102 and transmit the acquired health parameter data over a first communication link 114. Instances of the first communication link include Bluetooth, Near Field Communication (NFC) and such other low communication links The gateway module 106, is preferably, deployed close to the patient 102 for communicating with the one or more sensor units 104, that are attached to the patient 102. The gateway module 106 is identified by a gateway identifier, which can be an identification code for uniquely identifying the gateway module 106. Hence each patient 102 can be uniquely identified by a combination of the sensor identifier of each of the sensor units 104 and the gateway identifier, as the sensor identifier and the gateway identifier are unique identification codes for every sensor unit 104 and the gateway module 106.

In the disclosed embodiment, the gateway module 106 can be a high powered device such as a PDA, cell phone, or any other mobile device that can communicate via wireless communication technologies such as radio frequency, high power optical communication links and the like. The gateway module 106 can further include a receiver module 108, an edge intelligence module 112, and a transmitted module 110. The receiver module 108, can be configured to receive the acquired health parameter data, the acquired health parameter data being transmitted by the sensor unit 104, from the first communication link 114. On reception of the acquired health parameter data, the receiver module 108, transfers the acquired health parameter data to the edge intelligence module 112. The edge intelligence module 112 is preferably configured to aggregate a set of the received health parameter data over a first time interval and generate an alert when the aggregated set of health parameter data transgresses a preconfigured limit as set for the health parameter data or a preconfigured pattern as set for the health parameter data. The aggregation of the acquired health parameter data, ensures elimination of detection of a spurious health parameter or an erroneous health parameter as a medical emergency. The transmitter module 110 is configured to transmit; the aggregated set of acquired health parameter data on completion of the first time interval, and the generated alert over the second communication link 118. The generated alert includes the sensor identifier of the sensor unit 104 that measured the transgressed health parameter data, the gateway module identifier of the gateway module 106, the transgressed health parameter data and a connector identifier of a connector 116, where the connector is one of the plurality of connectors of the system that is nearest to the patient 102 when the alert is generated. The edge intelligence module 112, is preferably inbuilt with a capability of retrieving the connector identifier of the nearest connectors. The transmitter module 110, is configured to transmit the aggregated set of acquired health parameter data periodically on elapse of the first time interval and the generated alert over the second communication link 118, to the context server 120. Instance of the connector 116 can include, a Wireless Access Point(WAP) where the second communication link 118 is a wireless link.

The context server 120, is configured to allocate a unique patient identifier for each patient 102, based on a unique combination of the sensor identifier, and the gateway identifier as received from the second communication link 118 for a first time. The context server 120, further, associates or allocates the unique patient identifier to a medical agent 122. Instances of the medical agent 122 can include, a nurse, a doctor, and such medical personnel who may attend to the patient 102, when the alert is generated. The association of the unique patient identifier to the medical agent 122, symbolizes the allocation of the patient 102 to a particular medical agent. Further, the association can be based on a preference as set by the health care center. Instance of the preference could be assigning the medical agent 122, skilled in using Defibrillator, to a set of patients suffering from heart related issues.

In addition, the context server 120, is configured to receive the aggregated set of health parameter data periodically from the second communication link 118, and store it in a database. The context server 120 is further configured to receive the generated alert from the second communication link 118. The received alert is validated by the context server 120, in order to ascertain whether the generated alert corresponds to a true medical emergency. For the purpose of validating the received alert, the context server 120, is further configured to analyze the received set of aggregated health parameter data over a second time interval, where the second time interval is relatively greater than the first time interval. The step of analyzing the set of aggregated health parameter data includes aggregating the set of health parameter data over the second time interval, in order to determine whether that the received aggregated health parameter data represents a valid medical emergency. In an event where the analyzed health parameter data transgresses a preconfigured limit or a preconfigured pattern, the alert would be determined as valid, by virtue of representing a valid medical emergency. In an event, the analyzed health parameter data do not transgress the preconfigured limit or preconfigured pattern(s), the alert is determined to be invalid, and no further action would be mandated by the context server 120. For a validated alert, the context server 120, is configured to retrieve a location of the connector from a lookup table, the connector identifier of which is received in the alert. The lookup table can be a list of locations of the plurality of connectors present in the system and a list of connector identifiers of the plurality of connectors. In the disclosed embodiment, the preconfigured limit can be used as a reference for the health parameter data that are discrete in nature, while the preconfigured pattern(s) can be a reference for the health parameter data that are continuous in nature and that can be preferably described by physiological waveforms.

The context server 120, can be further configured to assign a color code for the validated alert, and transmit the assigned color code, the gateway identifier as received in the alert, and the retrieved location of the connector to the medical agent 122. The context server 120, may be configured to instruct the gateway module to emit a colored light, where the colored light corresponds to the assigned color code. The context server 120 assigns the color code for the validated alert based on the received connector identifier and a type of the received health parameter data in the validated alert. In an instance where, two or more patients within a similar location, report alerts containing similar type of health parameter data, the context server 120, can be configured to assign two or more distinct color codes for the reported alerts. Such an assignment ensures that, the gateway modules 106 of the two or more patients suffering from the similar ailment emit different colors, in order to avoid confusion in identification of the patients in the same room, by two or more medical agents 122. The context server 120 can be further configured to instruct the gateway module 106 to display the gateway identifier, along with emitting the colored light. On receiving the gateway identifier and the location of the connector, the medical agent 122, may move to the location specified, which indicates existence of a medical emergency, and check for the emission of the colored light and gateway identifier being displayed or flashed on the screen of the gateway. On observing the colored light and the gateway identifier from the gateway module 106 of the patient 102, the medical agent 122, may attend to the patient 102 and provide the necessary medical attention.

In the disclosed embodiment, the preconfigured limits can be customized for each patient 102 by the medical agent 122, in the gateway module 106 and in the context server 120. The preconfigured limits so customized, may be transferred from the context server 120 via the connector 116 over the second communication link 118, to the gateway module 106, for the purpose of synchronization. In an additional embodiment, the gateway module 106, can be configured to emit light in a direction other than the direction in which the gateway identifier would be displayed. As the context server 120, has more processing power, and memory capability, CPU and memory intensive complex algorithms can be run on the context server 120 to determine whether an aggregated waveform health parameter, matches with the preconfigured pattern(s) that are preferably programmed in the context server 120 for the patient 102.

Figure 2:
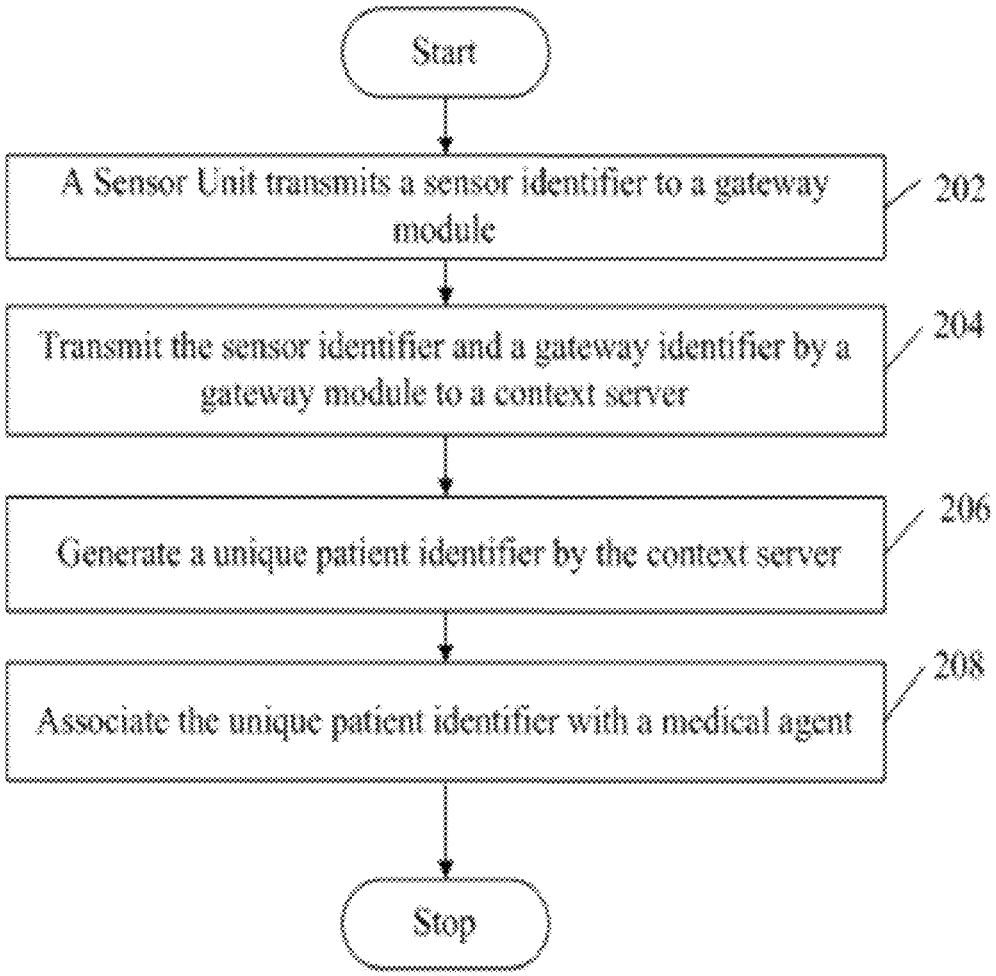
FIG. 2 is a flowchart illustrating an embodiment of a method for registering a patient for a first time for the purpose of identifying the patient.

FIG. 2 is a flowchart that illustrates a method performed for registering a patient for a first time for the purpose of identifying the patient in a health care location. At step 202, a sensor unit 104 associated, transmits a sensor identifier to a gateway module 106, where the gateway module 106 is in communication with the sensor unit 104 via a first communication link 118. At step 204, the gateway module 106, transmits the sensor identifier and the gateway identifier to a context server 120. In an embodiment, where the patient 102 is associated with more than one sensor unit 104, a combination comprising the sensor identifier of each of the sensor units 104, and the gateway identifier is transmitted to the context server 120. At step 206, a unique patient identifier is generated by the context server 120, on the basis of the received combination. At step 208, the context sever, associates the unique patient identifier with a medical agent 122, for attending to the patient 102.

Figure 3:
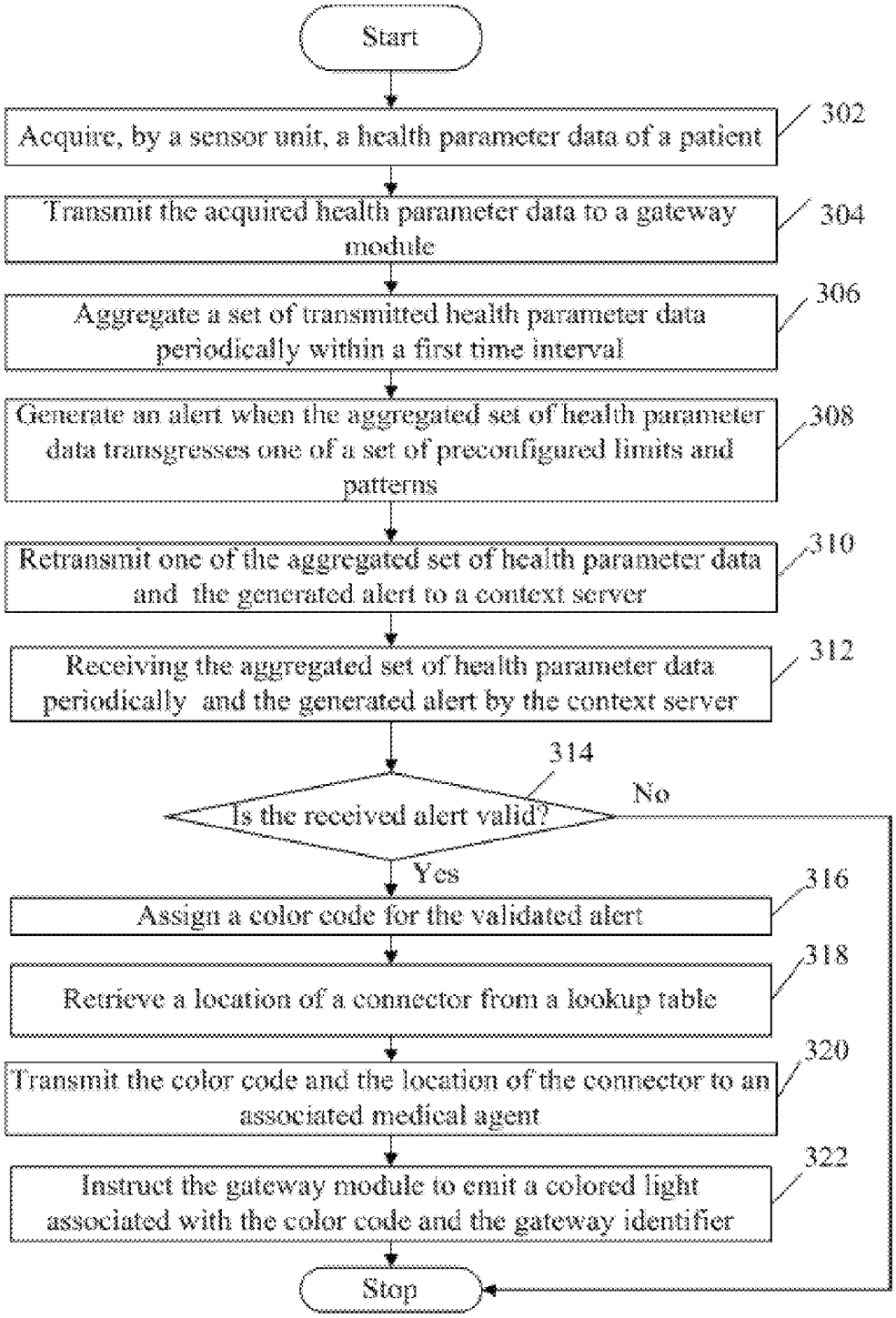
FIG. 3 is a flowchart illustrating an embodiment of a method for identifying a patient.

FIG. 3 is a flowchart that illustrates a method performed for identifying a patient requiring medical attention in a health care center. At step 302 a health parameter data is acquired by a sensor unit 104 attached to a patient. The acquired health parameter data is then transmitted to a gateway module 106 by the sensor unit 104 at step 304. At step 306, a set of transmitted health parameter data is aggregated periodically within a first time interval. In an event the aggregated set of health parameter data transgresses a set of preconfigured limits or preconfigured pattern(s), as stored for each patient in a database of the gateway module 106, an alert is generated at step 308. The alert can include a gateway identifier, the transgressed set of aggregated health parameter data, and a connector identifier of a connector nearest to the gateway module 106, at a time of generation of the alert. Instance of the connector 116 can include, a Wireless Access Point(WAP) where the second communication link 118 is a wireless link. Further, a transmitted module 110, of the gateway module 106, is configured to transmit the aggregated set of health parameter data and the generated alert via a second communication link 118, to a context server 120, at step 310. At step 312, the aggregated set of health parameter data or the generated alert is received by a context server 120. At step, 314, the received alert is checked for its validity. In an event the received alert is valid, a color code is assigned by the context server 120, to the validated alert at step 316. At step 318, a location of the connector is retrieved by the context server 120 from a lookup table, where the lookup table is stored in a database on the context server 120. At step 320, the assigned color code and the location of the connector is transmitted by the context server 120, to a medical agent 122. The gateway module 106, is instructed by the context server 120, to display the gateway identifier and emit a colored light associated with the colored code, at step 322. As a result, when the medical agent 122, reaches the location of the connector, the patient 102 can be identified from the colored light and the gateway identifier that would be displayed by the gateway module 106.

Figure 4:
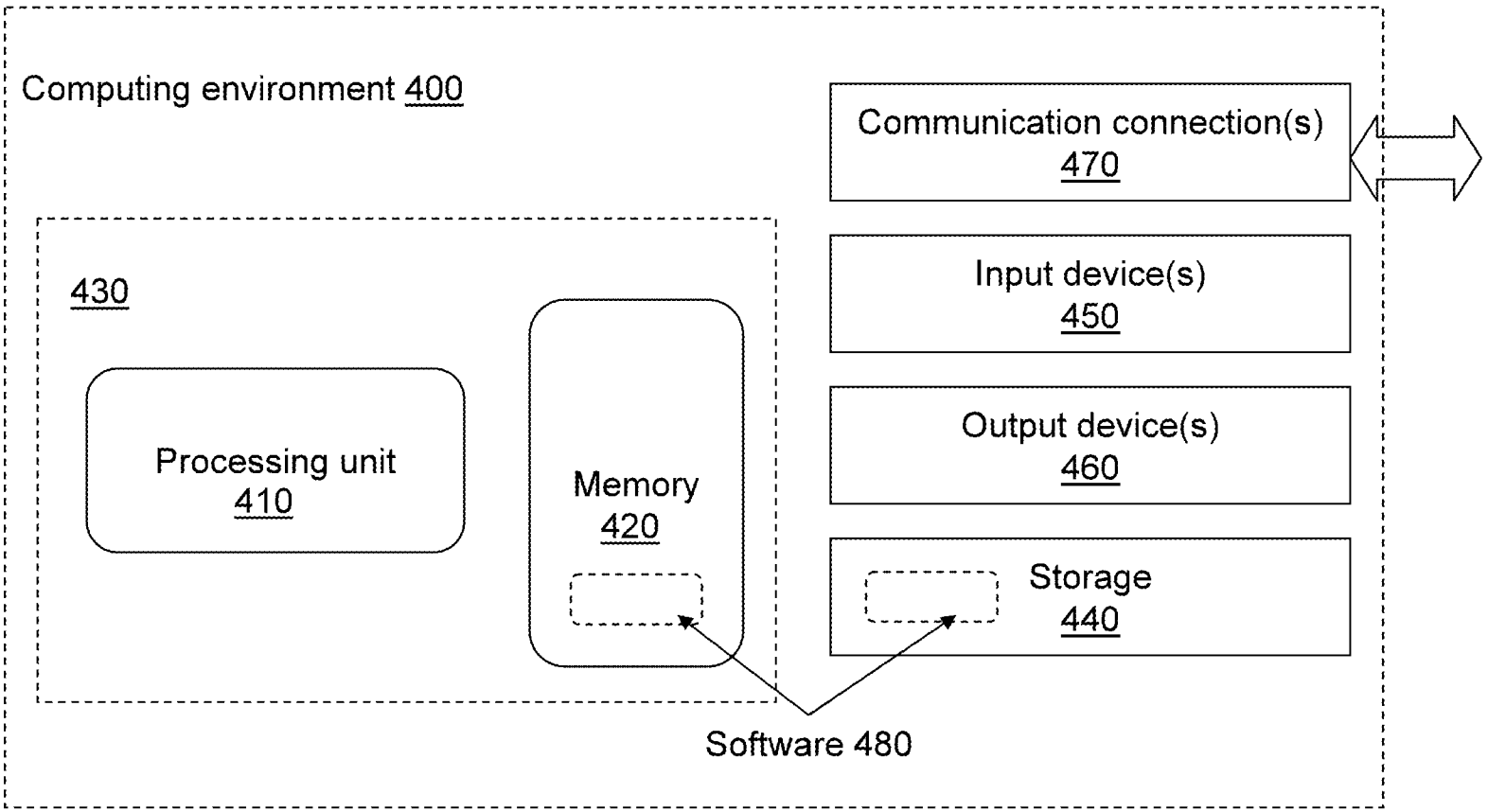
FIG. 4 illustrates a generalized example of a computing environment 400.

One or more of the above-described techniques can be implemented in or involve one or more computer systems. FIG. 4 illustrates a generalized example of a computing environment 400. The computing environment 400 is not intended to suggest any limitation as to scope of use or functionality of described embodiments.

With reference to FIG. 4, the computing environment 400 includes at least one processing unit 410 and memory 420. In FIG. 4, this most basic configuration 430 is included within a dashed line. The processing unit 410 executes computer-executable instructions and may be a real or a virtual processor. In a multi-processing system, multiple processing units execute computer-executable instructions to increase processing power. The memory 420 may be volatile memory (e.g., registers, cache, RAM), non-volatile memory (e.g., ROM, EEPROM, flash memory, etc.), or some combination of the two. In some embodiments, the memory 420 stores software 480 implementing described techniques.

A computing environment may have additional features. For example, the computing environment 400 includes storage 440, one or more input devices 440, one or more output devices 460, and one or more communication connections 470. An interconnection mechanism (not shown) such as a bus, controller, or network interconnects the components of the computing environment 400. Typically, operating system software (not shown) provides an operating environment for other software executing in the computing environment 400, and coordinates activities of the components of the computing environment 400.

The storage 440 may be removable or non-removable, and includes magnetic disks, magnetic tapes or cassettes, CD-ROMs, CD-RWs, DVDs, or any other medium which can be used to store information and which can be accessed within the computing environment 400. In some embodiments, the storage 440 stores instructions for the software 480.

The input device(s) 450 may be a touch input device such as a keyboard, mouse, pen, trackball, touch screen, a voice input device, a scanning device, a digital camera, or another device that provides input to the computing environment 400. The output device(s) 460 may be a display, printer, speaker, or another device that provides output from the computing environment 400.

The communication connection(s) 470 enable communication over a communication medium to another computing entity. The communication medium conveys information such as computer-executable instructions, audio or video information, or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

Implementations can be described in the general context of computer-readable media. Computer-readable media are any available media that can be accessed within a computing environment. By way of example, and not limitation, within the computing environment 400, computer-readable media include memory 420, storage 440, communication media, and combinations of any of the above.

Having described and illustrated the principles of our invention with reference to described embodiments, it will be recognized that the described embodiments can be modified in arrangement and detail without departing from such principles. It should be understood that the programs, processes, or methods described herein are not related or limited to any particular type of computing environment, unless indicated otherwise. Various types of general purpose or specialized computing environments may be used with or perform operations in accordance with the teachings described herein. Elements of the described embodiments shown in software may be implemented in hardware and vice versa.

As will be appreciated by those ordinary skilled in the art, the foregoing example, demonstrations, and method steps may be implemented by suitable code on a processor base system, such as general purpose or special purpose computer. It should also be noted that different implementations of the present technique may perform some or all the steps described herein in different orders or substantially concurrently, that is, in parallel. Furthermore, the functions may be implemented in a variety of programming languages. Such code, as will be appreciated by those of ordinary skilled in the art, may be stored or adapted for storage in one or more tangible machine readable media, such as on memory chips, local or remote hard disks, optical disks or other media, which may be accessed by a processor based system to execute the stored code. Note that the tangible media may comprise paper or another suitable medium upon which the instructions are printed. For instance, the instructions may be electronically captured via optical scanning of the paper or other medium, then compiled, interpreted or otherwise processed in a suitable manner if necessary, and then stored in a computer memory.

The following description is presented to enable a person of ordinary skill in the art to make and use the invention and is provided in the context of the requirement for a obtaining a patent. The present description is the best presently-contemplated method for carrying out the present invention. Various modifications to the preferred embodiment will be readily apparent to those skilled in the art and the generic principles of the present invention may be applied to other embodiments, and some features of the present invention may be used without the corresponding use of other features. Accordingly, the present invention is not intended to be limited to the embodiment shown but is to be accorded the widest scope consistent with the principles and features described herein.

While the foregoing has described certain embodiments and the best mode of practicing the invention, it is understood that various implementations, modifications and examples of the subject matter disclosed herein may be made. It is intended by the following claims to cover the various implementations, modifications, and variations that may fall within the scope of the subject matter described.

What is claimed is:

1. A system for identifying a patient, the system comprising:

one or more sensor units associated with the patient, whereby each sensor unit is configured to acquire a health parameter data of the patient and transmit the acquired health parameter data over a first communication link;

a gateway module associated with the patient, the gateway module comprising a receiver module configured to receive the acquired health parameter data from the first communication link;

an edge intelligence module configured to aggregate a set of the acquired health parameter data periodically within a first time interval and generate an alert when the aggregated set of health parameter data transgresses one of a set of preconfigured limits and patterns;

a transmitter module configured to transmit the aggregated set of acquired health parameter data periodically after the first time interval and transmit the generated alert, whereby the generated alert comprises a sensor identifier of the sensor unit, a gateway identifier of the gateway module, and a connector identifier of a connector, and the aggregated set of health parameter data of the first time interval, over a second communication link; and a context server configured to receive the aggregated set of health parameter data periodically and the generated alert from the second communication link, generate a unique patient identifier for the patient, when the sensor identifier and the gateway identifier are received from the gateway module for a first time, validate the received alert, retrieve a location of the connector from a lookup table, assign a color code for the validated alert, transmit the color code, the gateway identifier, and the location of the connector to a medical agent, in an event the received alert is valid, and instruct the gateway module to emit a colored light associated with the color code, in an event the received alert is valid.

2. The system of claim 1, wherein the context server is further configured to associate the unique patient identifier with the medical agent.

3. The system of claim 1, wherein the set of preconfigured limits is customized for each patient.

4. The system of claim 1, wherein the connector is one of the plurality of connectors nearest to the patient at a point of time when the alert is generated.

5. The system of claim 1, wherein the context server is further configured to instruct the gateway module to display the gateway identifier, when the received alert is validated.

6. The system of claim 1, wherein the color code is assigned based on the received connector identifier and a type of the health parameter of the validated alert.

7. The system of claim 4, wherein the context server configured to validate the generated alert is further configured to:

analyze the received aggregated set of health parameter data over a second time interval; and determine the alert as valid, when the analyzed set of health parameter data transgress one of the set of preconfigured limits and patterns.

8. The system of claim 7, wherein the second time interval is greater than the first time interval.

9. The system of claim 1, wherein the lookup table includes a list of locations of the plurality of connector sand a connector identifier for each of the plurality of connectors.

10. A method for identifying a patient, the method comprising:

acquiring, by a sensor unit, a health parameter data, of a patient;

transmitting, by the sensor unit over a first communication link, the acquired health parameter data to a gateway module;

aggregating, by an edge intelligence module, a set of the acquired health parameter data periodically within a first time interval;

generating, by the edge intelligence module, an alert, when the aggregated set of health parameter data transgresses one of a set of preconfigured limits and patterns;

retransmitting, by a transmitter module over a second communication link, one of the aggregated set of health parameter data and the generated alert, whereby the generated alert comprises a sensor identifier of the sensor unit, a gateway identifier of the gateway module, a connector identifier of a connector and the transgressed set of health parameter data;

receiving, by a context server, the aggregated set of health parameter data periodically, and the generated alert from the second communication link;

validating, by the context server, the received alert;

transmitting a color code, the gateway identifier and a location of the connector to a medical agent, in an event the alert is valid; and instructing the gateway module to emit a colored light associated with the color code in an event the alert is valid.

11. The method of claim 10, further comprising:

generating, by the context server, a unique patient identifier for the anonymous patient, when the sensor identifier and the gateway identifier are received by the context server for a first time;

assigning, by the context server, the color code for the received alert, when the received alert is valid;

retrieving, by the context server, the location of the connector from a lookup table;

associating the unique patient identifier with the medical agent; and instructing the gateway module to display the gateway identifier, in an event the alert is valid.

12. The method of claim 11, wherein the lookup table includes a list of locations of the plurality of connectors and a connector identifier for each of the plurality of connectors.

13. The method of claim 10, further comprising:

receiving, by a receiver module disposed within the gateway module, the acquired health parameter data from the first communication link.

14. The method of claim 10, wherein the edge intelligence module and the transmitter module are disposed within the gateway module.

15. The method of claim 10, wherein the set of preconfigured limits, is customized for each patient.

16. The method of claim 10, wherein the connector is one of the plurality of connectors nearest to the patient at a point of time when the alert is generated.

17. The method of claim 10, wherein the color code is assigned based on the connector identifier and a type of the health parameter of the validated alert.

18. The method of claim 10, wherein the step of validating the alert further comprises:

analyzing, by the context server, the received aggregated set of health parameter data over a second time interval; and determining the alert as valid, when the analyzed set of health parameter data transgress one of the set of preconfigured limits and patterns.

19. The method of claim 18, wherein the second time interval is greater than the first time interval.

20. A computer program product consisting of a plurality of program instructions stored on a non-transitory computer-readable medium that, when executed by a computing device, performs a method for identifying a patient, the method comprising:

acquiring, by a sensor unit, a health parameter data, of a patient;

transmitting, by the sensor unit over a first communication link, the acquired health parameter data to a gateway module;

aggregating, by an edge intelligence module, a set of the acquired health parameter data periodically within a first time interval;

generating, by the edge intelligence module, an alert, when the aggregated set of health parameter data transgresses one of a set of preconfigured limits and patterns;

retransmitting, by a transmitter module over a second communication link, one of the aggregated set of health parameter data and the generated alert, whereby the generated alert comprises a sensor identifier of the sensor unit, a gateway identifier of the gateway module, a connector identifier of a connector and the transgressed set of health parameter data;

receiving, by a context server, the aggregated set of health parameter data periodically and the generated alert from the second communication link;

validating, by the context server, the received alert;

transmitting a color code, the gateway identifier and a location of the connector to a medical agent, in an event the alert is valid;

instructing the gateway module to emit a colored light associated with the color code in an event the alert is valid.

21. The computer program product of claim 20, the method further comprising:

generating, by the context server, a unique patient identifier for the anonymous patient, when the sensor identifier and the gateway identifier are received by the context server for a first time;

assigning, by the context server, the color code for the received alert, when the received alert is valid;

retrieving, by the context server, the location of the connector from a lookup table;

associating the unique patient identifier with the medical agent; and instructing the gateway module to display the gateway identifier, in an event the alert is valid.

22. The computer program product of claim 21, wherein the lookup table includes a list of locations of the plurality of connector and a connector identifier for each of the plurality of connector.

23. The computer program product of claim 20, the method further comprising:

receiving, by a receiver module disposed within the gateway module, the acquired health parameter data from the first communication link.

24. The computer program product of claim 20, wherein the edge intelligence module and the transmitter module are disposed within the gateway module.

25. The computer program product of claim 20, wherein the set of preconfigured limits, is customized for each patient.

26. The computer program product of claim 20, wherein the connector is one of the plurality of connectors nearest to the patient at a point of time when the alert is generated.

27. The computer program product of claim 20, wherein the color code is assigned based on the connector identifier and a type of the health parameter of the validated alert.

28. The computer program product of claim 20, wherein the step of validating the alert further comprises:

analyzing, by the context server, the received aggregated set of health parameter data over a second time interval; and determining the alert as valid, when the analyzed set of health parameter data transgress one of the set of preconfigured limits and patterns.

29. The computer program product of claim 28, wherein the second time interval is greater than the first time interval.

* * * * *